US009195180B2

(12) United States Patent
Hasegawa

(10) Patent No.: US 9,195,180 B2
(45) Date of Patent: Nov. 24, 2015

(54) IMAGE HEATING APPARATUS AND IMAGE FORMING APPARATUS

(71) Applicant: CANON KABUSHIKI KAISHA, Tokyo (JP)

(72) Inventor: Takuya Hasegawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/091,669

(22) Filed: Nov. 27, 2013

(65) Prior Publication Data

US 2014/0153947 A1 Jun. 5, 2014

(30) Foreign Application Priority Data

Nov. 30, 2012 (JP) ..... 2012-263767

(51) Int. Cl.
*G03G 15/20* (2006.01)

(52) U.S. Cl.
CPC ..... *G03G 15/2014* (2013.01); *G03G 15/2053* (2013.01); *G03G 2215/2019* (2013.01)

(58) Field of Classification Search
CPC ..... G03G 15/2053; G03G 15/2064; G03G 2215/2035; G03G 2215/2038; G03G 15/2017; G03G 15/2039; G03G 2215/00156; G03G 2215/2019; G03G 15/2014; G03G 15/2025; G03G 15/2046; G03G 15/205; G03G 15/2057
See application file for complete search history.

(56) References Cited

U.S. PATENT DOCUMENTS

| | | | | |
|---|---|---|---|---|
| 6,078,766 | A | 6/2000 | Kurotaka | |
| 6,198,902 | B1 | 3/2001 | Vaughan et al. | |
| 7,383,012 | B2 | 6/2008 | Sata | |
| 7,430,394 | B2 | 9/2008 | Fujimori et al. | |
| 7,596,334 | B2 | 9/2009 | Yoshino et al. | |
| 7,711,306 | B2 | 5/2010 | Kagawa | |
| 7,761,045 | B2 | 7/2010 | Fujimori et al. | |
| 2004/0190958 | A1 * | 9/2004 | Matsumoto | 399/329 |

(Continued)

FOREIGN PATENT DOCUMENTS

| | | | |
|---|---|---|---|
| CN | 1786846 | A | 6/2006 |
| CN | 101101475 | A | 1/2008 |

(Continued)

OTHER PUBLICATIONS

U.S. Appl. No. 14/178,557 to Takuya Hasegawa, filed Feb. 12, 2014.

(Continued)

*Primary Examiner* — Roy Y Yi
(74) *Attorney, Agent, or Firm* — Fitzpatrick, Cella, Harper & Scinto

(57) ABSTRACT

An image heating apparatus includes: a rotatable heating member; a belt unit including an endless belt configured to heat the rotatable heating member, and a supporting portion configured to rotatably support an inner surface of the endless belt; a contact portion configured to contact a widthwise edge of the endless belt; an urging portion configured to urge the contact portion toward the widthwise edge of the endless belt; a detecting portion configured to detect, that the endless belt is out of a predetermined zone, depending on a position of the contact portion; a tilting portion configured to tilt the belt unit in a direction of causing the endless belt to return into the predetermined zone on the basis of an output of the detecting portion; and a retracting portion configured to retract the contact portion from the endless belt against an urging force of the urging portion.

16 Claims, 13 Drawing Sheets

(56) References Cited

U.S. PATENT DOCUMENTS

| | | | | |
|---|---|---|---|---|
| 2006/0133869 | A1 | 6/2006 | Sata | |
| 2007/0189817 | A1 | 8/2007 | Kagawa | |
| 2008/0003029 | A1 | 1/2008 | Fujimori et al. | |
| 2008/0112738 | A1* | 5/2008 | Yoshino et al. | 399/329 |
| 2008/0138125 | A1 | 6/2008 | Katayama | |
| 2008/0317526 | A1 | 12/2008 | Fujimori et al. | |
| 2009/0317115 | A1 | 12/2009 | Motoyama | |
| 2011/0142496 | A1* | 6/2011 | Kameda | 399/122 |
| 2013/0209145 | A1 | 8/2013 | Hasegawa | |
| 2013/0266353 | A1* | 10/2013 | Chikugo | 399/329 |
| 2014/0086647 | A1 | 3/2014 | Hasegawa | |
| 2014/0093287 | A1 | 4/2014 | Hasegawa | |

FOREIGN PATENT DOCUMENTS

| | | | |
|---|---|---|---|
| CN | 101183233 | A | 5/2008 |
| EP | 2 629 153 | A2 | 8/2013 |
| EP | 2 713 222 | A2 | 4/2014 |
| JP | 2007-212896 | A | 8/2007 |
| JP | 2010-107659 | A | 5/2010 |
| WO | 2013/008943 | A1 | 1/2013 |

OTHER PUBLICATIONS

U.S. Appl. No. 14/178,542 to Takuya Hasegawa, filed Feb. 12, 2014.

U.S. Appl. No. 14/083,994 to Takuya Hasegawa, filed Nov. 19, 2013.

Great Britain Office Action dated May 20, 2014, in counterpart UK Application No. GB1320371.6.

Chinese Office Action dated Sep. 21, 2015, in counterpart CN Application No. 201310629566.6.

* cited by examiner (a)

(b)

(a)

(b)

IMAGE HEATING APPARATUS AND IMAGE FORMING APPARATUS

FIELD OF THE INVENTION AND RELATED ART

The present invention relates to an image forming apparatus such as a printer, a copying machine, a facsimile machine or a multi-function machine having a plurality of functions of these machines, and relates to an image heating apparatus usable in such an image forming apparatus.

Various image forming apparatuses have been conventionally known, but those of the electrophotographic type have come into wide use. Such image forming apparatuses are required to provide high productivity (the print number per unit time) with respect to various sheets (recording materials) such as thick paper.

Incidentally, in the image forming apparatus of the electrophotographic type as described above, particularly in order to improve the productivity with respect to the thick paper having a large basis weight, speed-up of a fixing speed of a fixing device or apparatus (image heating apparatus) is required. However, in the case of the thick paper, compared with the case of thin paper, heat in a large amount is taken from the fixing device with sheet passing, and therefore a heat quantity required for fixing becomes large. For that reason, in the case of the thick paper, a coping method in which the productivity is lowered (by decreasing the fixing speed or the print number per unit time) has been known.

As a coping method in which the productivity is not lowered with respect to the thick paper, an externally heating type (method) in which a member is contacted to an outer surface of a fixing roller (rotatable heating member) to maintain an outer surface temperature of the fixing roller has been devised. As such an externally heating type, in order to improve a fixing roller temperature maintaining performance by remarkably increasing a contact area with the fixing roller, use of an externally heating belt (endless belt) rotatably stretched by two supporting rollers has been proposed (Japanese Laid-Open Patent Application (JP-A) 2007-212896).

However, it is actually difficult to assemble the externally heating belt with the two supporting rollers with high accuracy of parallelism between the two supporting rollers and to maintain the parallelism with high accuracy. As a result, when the parallelism between the two supporting rollers is not ensured, the externally heating belt is shifted in a widthwise direction thereof, so that there is a fear that travelling stability of the externally heating belt becomes worse.

Therefore, with respect to such a fear, it would be considered that a method in which the (lateral) shift of the externally heating belt is controlled by inclining one of the supporting rollers with respect to the other supporting roller is used, but in the case of the externally heating belt performing a function of heating the fixing roller, it is difficult to employ this method.

This is because in the cases of this method, a constitution in which an end side of one of the supporting roller with respect to an axial direction is displaced with respect to another end side of the one of the supporting rollers is employed, but there is a fear that a part of a region where the externally heating belt is to be contacted to the fixing roller is separated (spaced) from the fixing roller by displacement of this one of the supporting roller. As a result, a function of the externally heating belt for heating the fixing roller is impaired, so that improper fixing is invited.

SUMMARY OF THE INVENTION

A principal object of the present invention is to provide an image heating apparatus capable of improving traveling stability of an endless belt.

Another object of the present invention is to provide an image forming apparatus capable of improving the traveling stability of the endless belt.

According to an aspect of the present invention, there is provided an image heating apparatus comprising: a rotatable heating member configured to heat an image on a sheet; a belt unit including an endless belt configured to heat the rotatable heating member in contact with an outer surface of the rotatable heating member, and a supporting portion configured to rotatably support an inner surface of the endless belt; a contact portion configured to contact a widthwise edge of the endless belt; an urging portion configured to urge the contact portion toward the widthwise edge of the endless belt; a detecting portion configured to detect, that the endless belt is out of a predetermined zone, depending on a position of the contact portion; a tilting portion configured to tilt the belt unit in a direction of causing the endless belt to return into the predetermined zone on the basis of an output of the detecting portion; and a retracting portion configured to retract the contact portion from the endless belt against an urging force of the urging portion.

According to another aspect of the present invention, there is provided an image forming apparatus comprising: a belt unit including an endless belt and a supporting portion configured to rotatably support an inner surface of the endless belt; a rotatable driving member configured to rotate the endless belt by rotation thereof in contact with an outer surface of the endless belt; a contact portion configured to contact a widthwise edge of the endless belt; an urging portion configured to urge the contact portion toward the widthwise edge of the endless belt; a detecting portion configured to detect, that the endless belt is out of a predetermined zone, depending on a position of the contact portion; a tilting portion configured to tilt the belt unit in a direction of causing the endless belt to return into the predetermined zone on the basis of an output of the detecting portion; and a retracting portion configured to retract the contact portion from the endless belt against an urging force of the urging portion.

These and other objects, features and advantages of the present invention will become more apparent upon a consideration of the following description of the preferred embodiments of the present invention taken in conjunction with the accompanying drawings.

Figure 4:
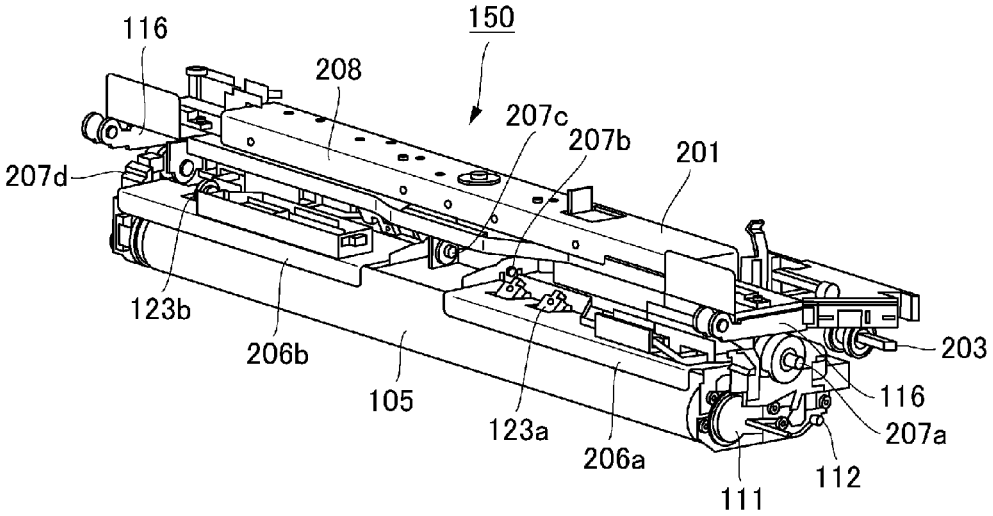
Figure 4:
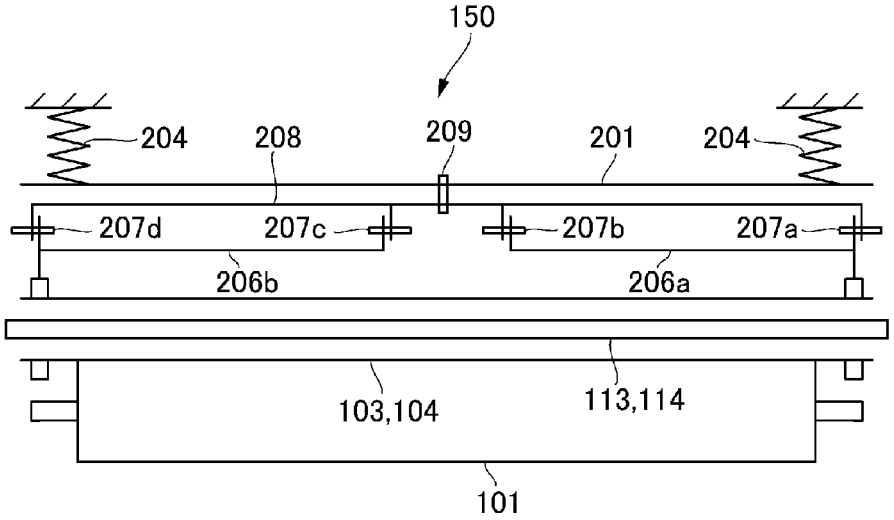

Parts (a) and (b) of FIG. 4 are a perspective view and a mechanism view, respectively, of an externally heating unit.

Figure 5:
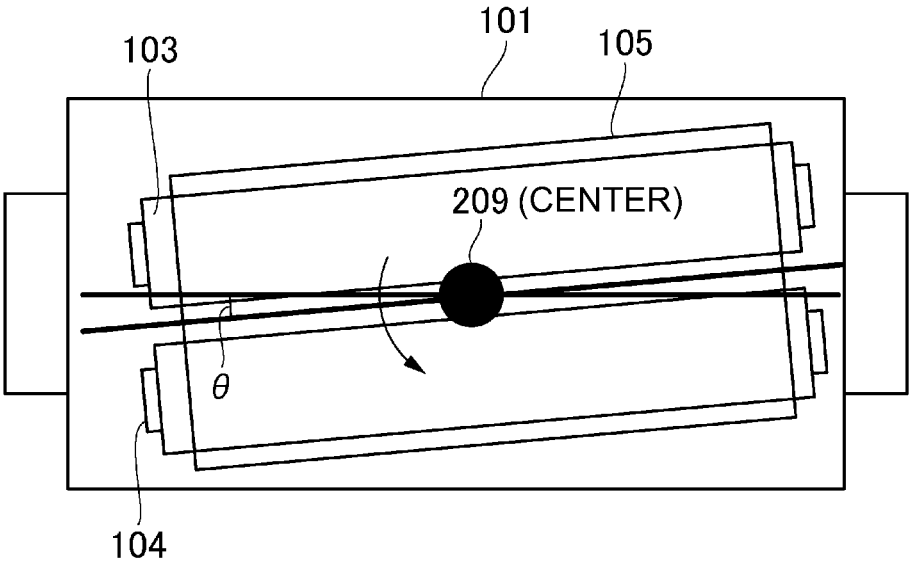

FIG. 5 is an illustration of a crossing angle between a fixing roller and the externally heating belt.

Figure 6:
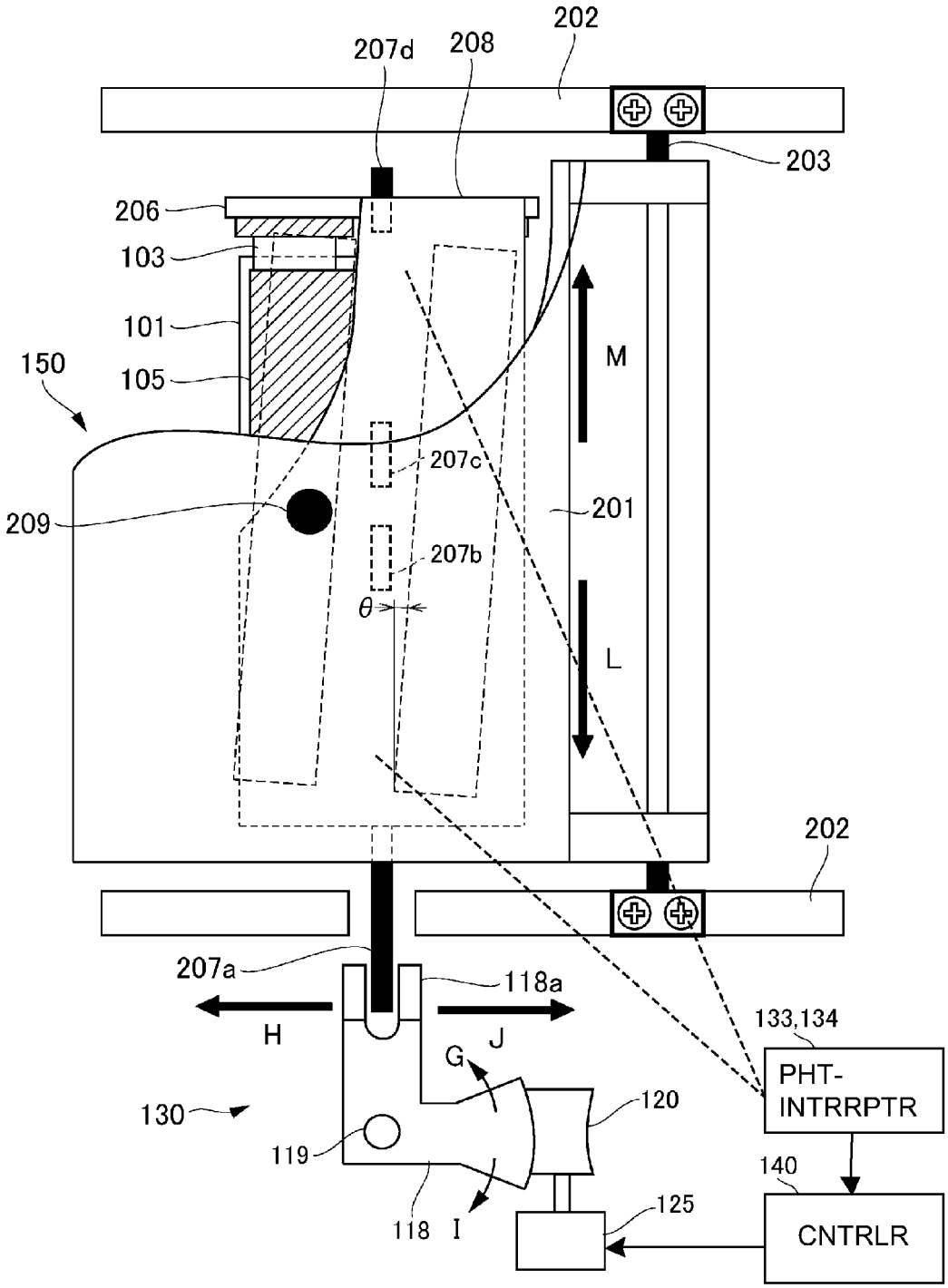

FIG. 6 is an illustration of a steering mechanism for the externally heating belt.

Figure 7:
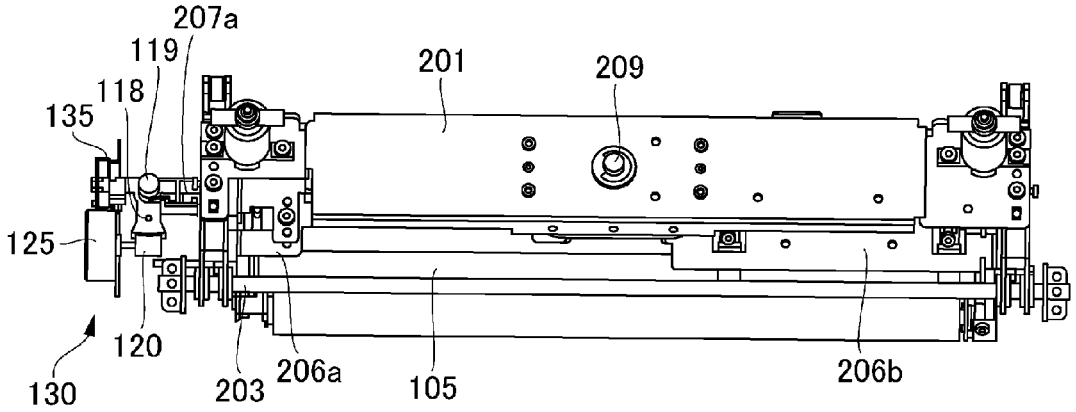

FIG. 7 is an illustration of a driving portion of the steering mechanism.

Figure 8:
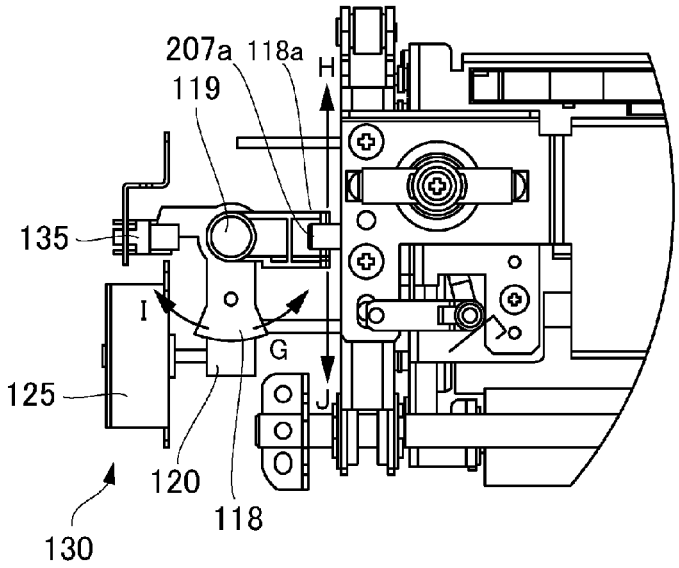

FIG. 8 is an enlarged view of the driving portion of the steering mechanism.

Figure 9:
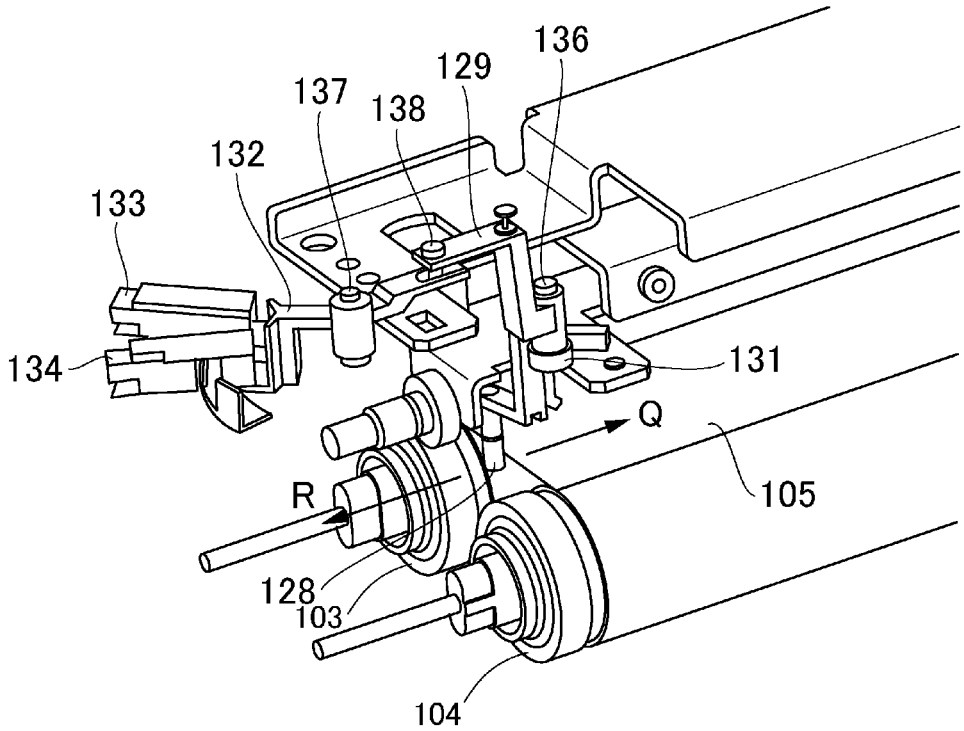

FIG. 9 is an illustration of an arrangement of a belt lateral deviation (shift) amount detecting sensor.

Figure 10:
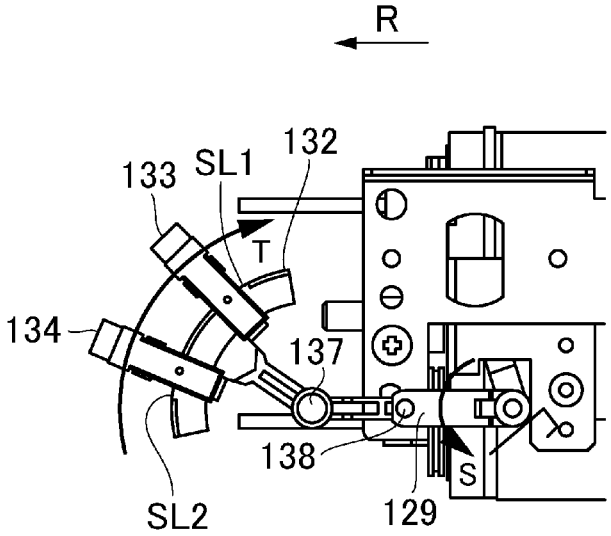
Figure 10:
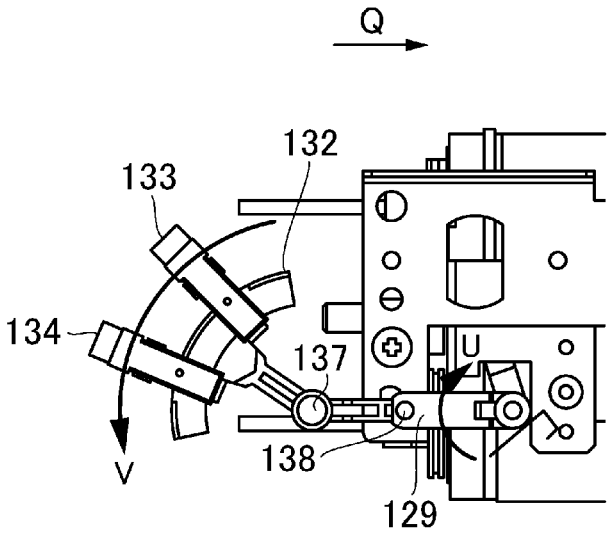

Part (a) of FIG. 10 is an illustration of a relationship between a belt lateral deviation direction and a rotational direction of a sensor flag in the case where the belt is shifted in a longitudinal front side, and (b) of FIG. 10 is an illustration of the relationship between the belt lateral deviation direction and the rotational direction of the sensor flag in the case where the belt is shifted in a longitudinal rear side.

Figure 11:
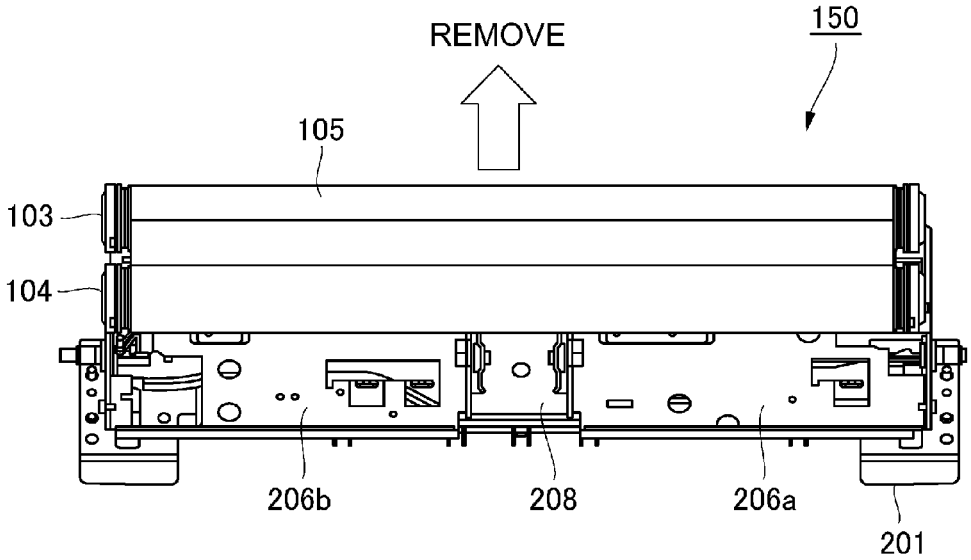

FIG. 11 is an illustration of an exchanging operation of the externally heating belt.

Figure 12:
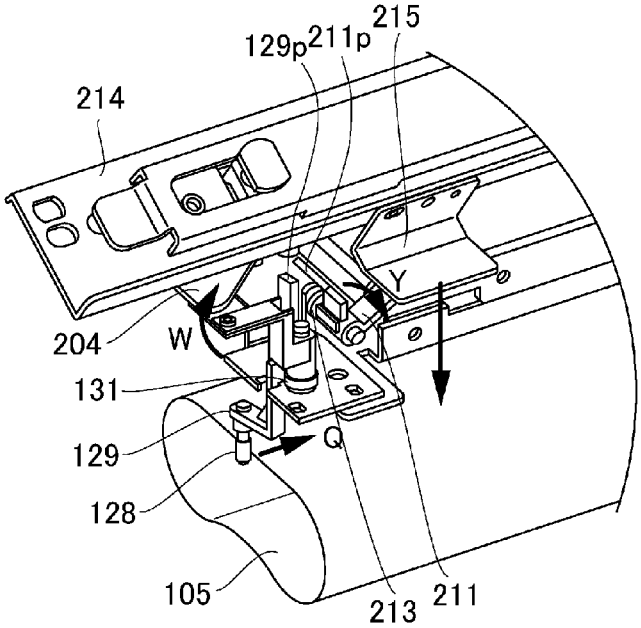

FIG. 12 is an illustration of an operation of a sensor retracting mechanism.

Figure 13:
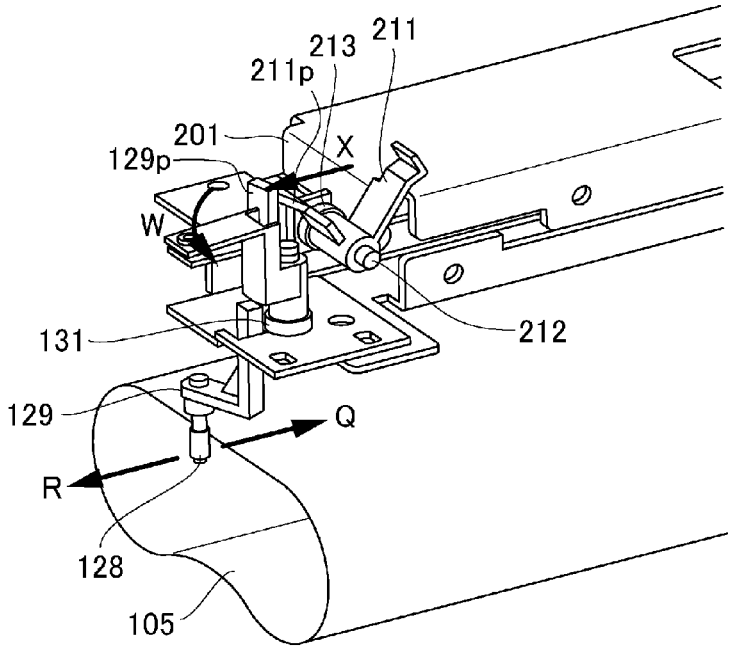

FIG. 13 is an illustration of a structure of the sensor retracting mechanism.

Figure 14:
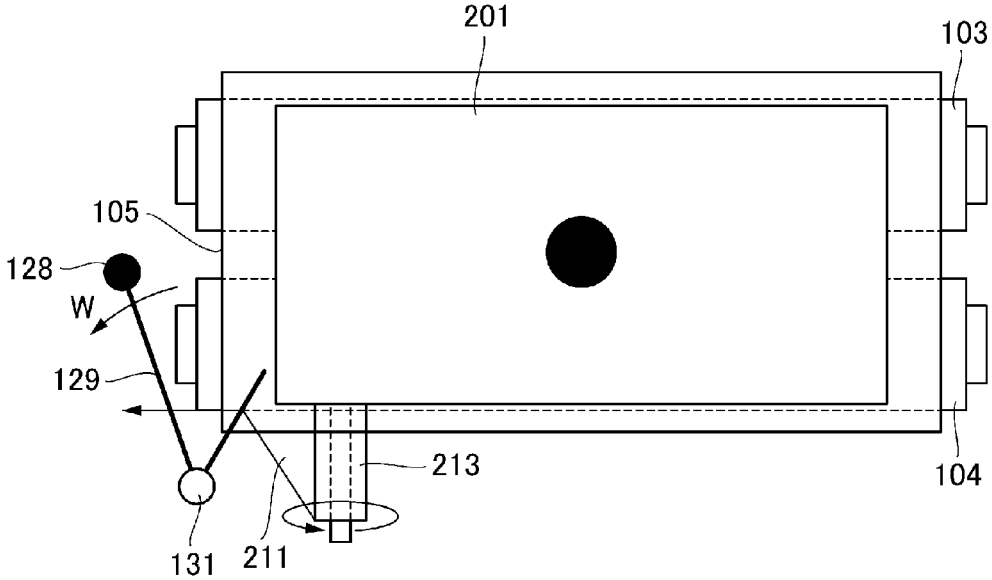

FIG. 14 is an illustration of an operation of a retracting member.

Figure 15:
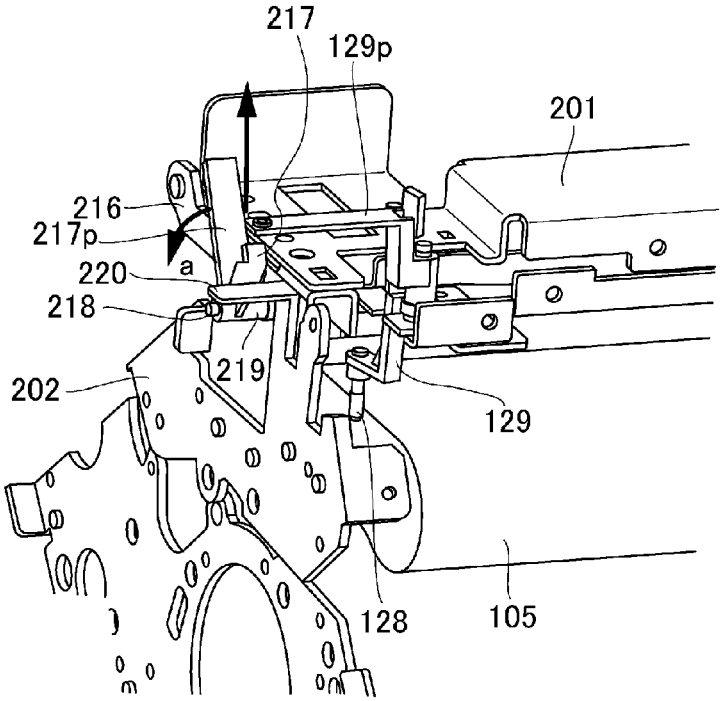

FIG. 15 is an illustration of an operation of a sensor retracting mechanism.

Figure 16:
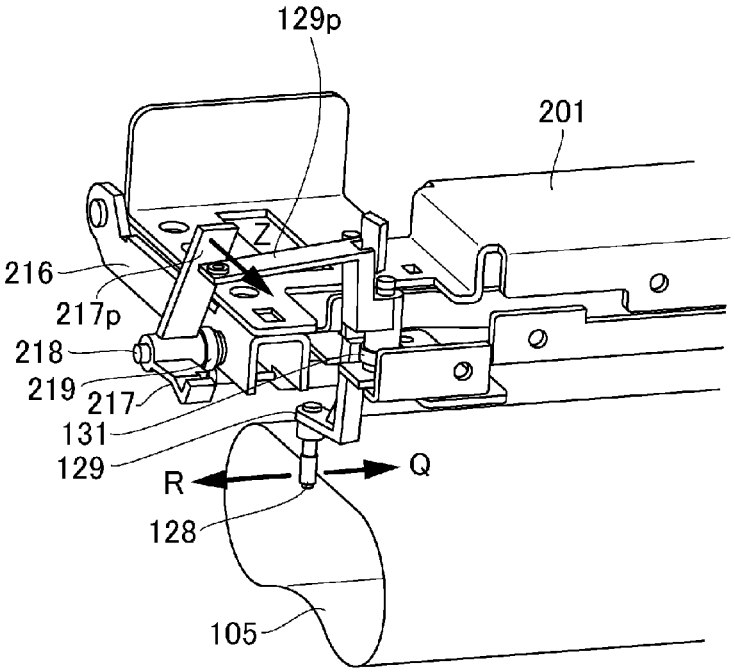

FIG. 16 is an illustration of a structure of the sensor retracting mechanism.

Figure 17:
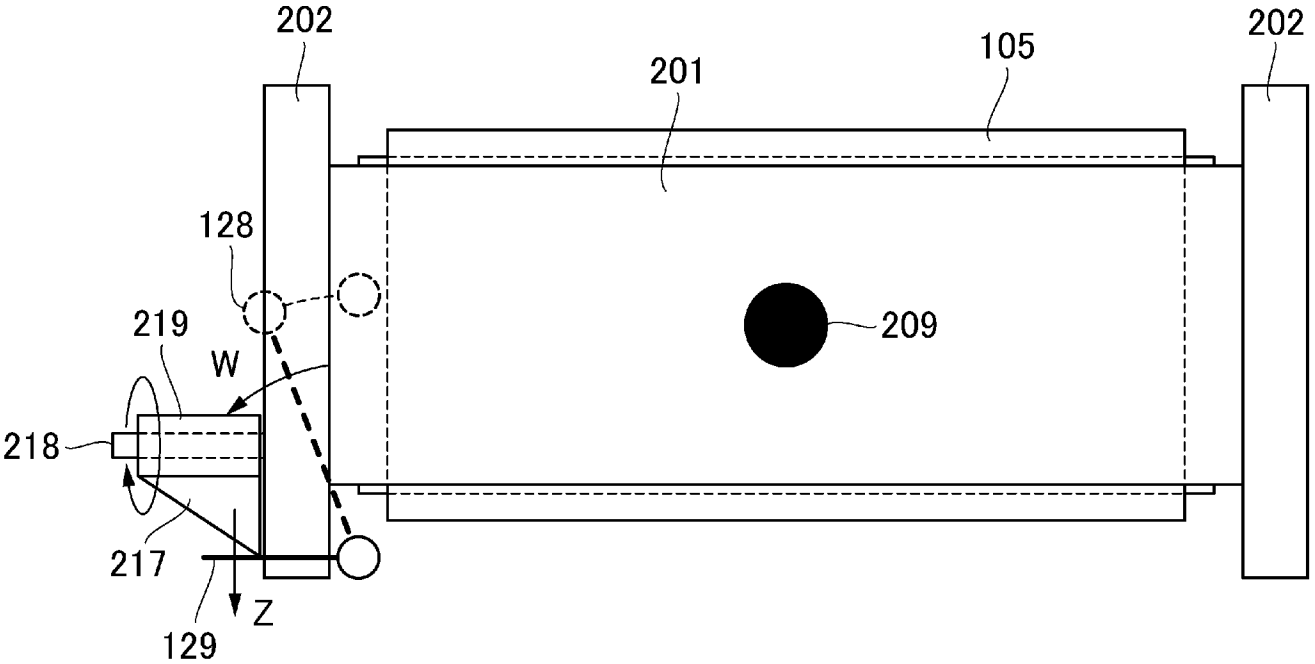

FIG. 17 is an illustration of an operation of a retracting member.

DESCRIPTION OF THE PREFERRED EMBODIMENTS

Embodiments of the present invention will be specifically described below with reference to the drawings.

<Image Forming Apparatus>

Figure 1:
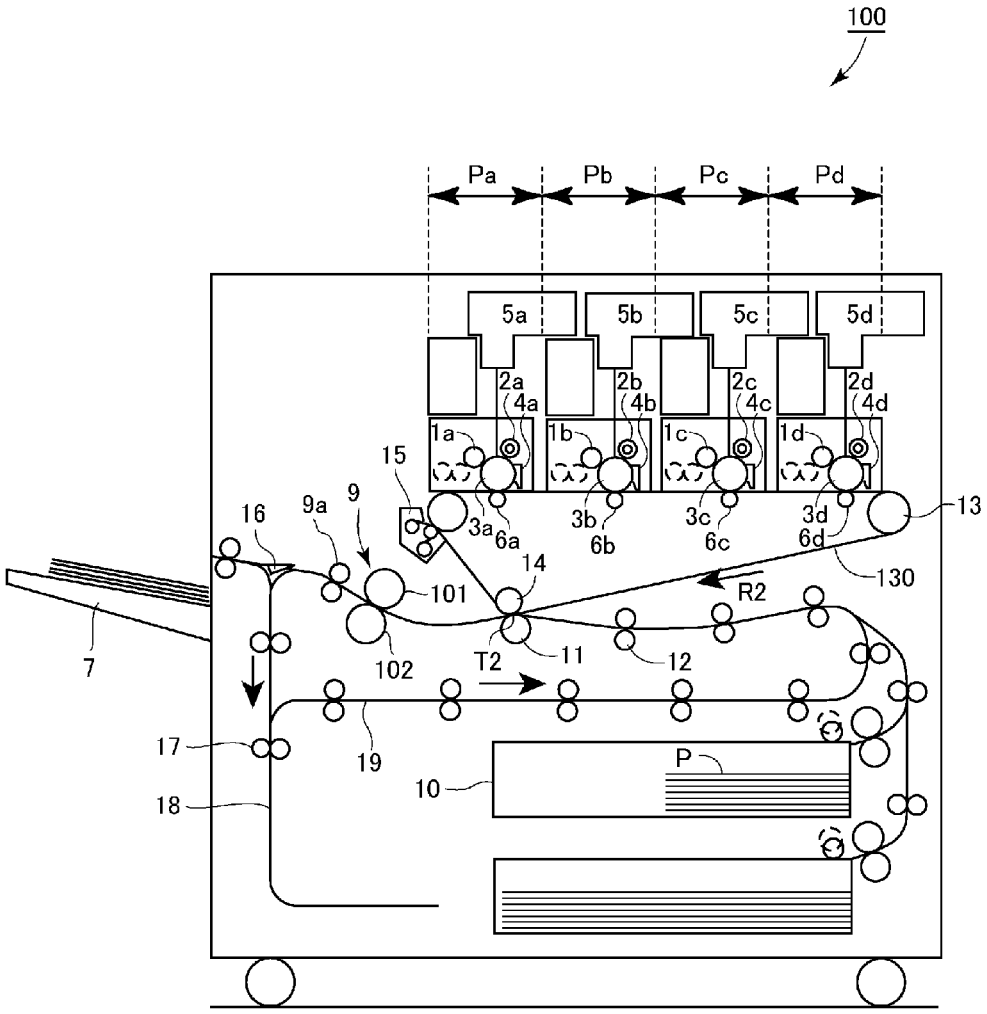
FIG. 1 is an illustration of a structure of an image forming apparatus.

FIG. 1 is an illustration of a structure of an image forming apparatus 100. As shown in FIG. 1, the image forming apparatus 100 is a tandem-type full-color printer of an intermediary transfer type in which image forming portions Pa, Pb, Pc and Pd for yellow, magenta, cyan and black, respectively are arranged along an intermediary transfer belt 130.

In the image forming portion Pa, a yellow toner image is formed on a photosensitive drum 3*a*, and then is primary-transferred onto the intermediary transfer belt 130. In the image forming portion Pb, a magenta toner image is formed on a photosensitive drum 3*b*, and then is primary-transferred onto the intermediary transfer belt 130. In the image forming portions Pc and Pd, a cyan toner image and a black toner image are formed on photosensitive drums 3*c* and 3*d*, respectively, and then are primary-transferred successively onto the intermediary transfer belt 130.

A recording material (sheet) P is taken out from a recording material cassette 10 one by one by and is in stand-by between registration rollers 12. The recording material P is sent by the registration rollers 12 to a secondary transfer portion T2 while being timed to the toner images on the intermediary transfer belt 130. The recording material P on which the four color toner images are secondary-transferred at the secondary transfer portion T2 is conveyed into a fixing device (apparatus) 9 and is heated and pressed by the fixing device 9 to fix the toner images thereon. Thereafter, the recording material P is discharged onto a tray 7 outside the image forming apparatus.

The image forming portions Pa, Pb, Pc and Pd have the substantially same constitution except that the colors of toners of yellow, magenta, cyan and black used in developing devices 1*a*, 1*b*, 1*c* and 1*d* are different from each other. In the following description, the image forming portion Pa will be described and other image forming portions Pb, Pc and Pd will be omitted from redundant description.

The image forming portion Pa includes the photosensitive drum 3*a* around which a charging roller 2*a*, an exposure device 5*a*, the developing device 1*a*, a primary transfer roller 6*a*, and a drum cleaning device 4*a* are provided. The photosensitive drum 3*a* is prepared by forming a photosensitive layer on the surface of an aluminum cylinder. The charging roller 2*a* electrically charges the surface of the photosensitive drum 3*a* to a uniform potential. The exposure device 5*a* writes (forms) an electrostatic image for an image on the photosensitive drum 3*a* by scanning with a laser beam. The developing device 1*a* develops the electrostatic image to form the toner image on the photosensitive drum 3*a*. The primary transfer roller 6*a* is supplied with a voltage, so that the toner image on the photosensitive drum 3*a* is primary-transferred onto the intermediary transfer belt 130.

The drum cleaning device 4*a* rubs the photosensitive drum 3*a* with a cleaning blade to collect a transfer residual toner deposited on the photosensitive drum 3*a* without being transferred onto the intermediary transfer belt 130. A belt cleaning 15 collects a transfer residual toner deposited on the intermediary transfer belt 130 without being transferred onto the recording material P at the secondary transfer portion T2.

Embodiment 1

(Fixing Device)

Figure 2:
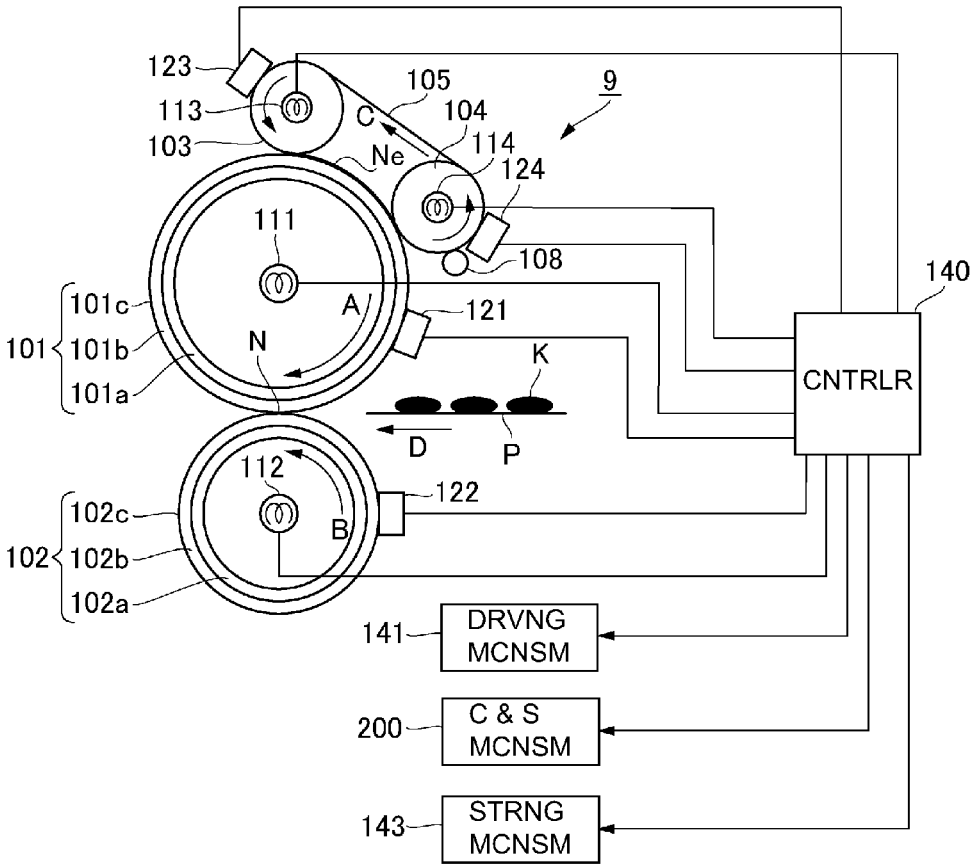
FIG. 2 is an illustration of a structure of a fixing device (apparatus).

FIG. 2 is a schematic sectional view of the fixing device functioning as an image heating apparatus.

As shown in FIG. 2, in the fixing device 9, a nip N is formed by causing a pressing roller 102 to press-contact a fixing roller 101 functioning as a rotatable heating member. At the nip N, the recording material P on which an unfixed toner K is carried is nipped and conveyed, and an image is fixed on the recording material P by melting the unfixed toner on the recording material P.

The fixing roller 101 includes a core metal 101*a* and an elastic layer 101*b* formed on an outer peripheral surface of the core metal 101*a*, and a surface of the elastic layer 101*b* is coated with a parting layer 101*c*. The fixing roller 101 is rotationally driven by a driving mechanism 141 including an unshown gear train, thus being rotated in an arrow A direction at 300 mm/sec.

The pressing roller 102 includes a core metal 102*a* and an elastic layer 102*b* formed on an outer peripheral surface of the core metal 102*a*, and a surface of the elastic layer 102*b* is coated with a parting layer 102*c*. The pressing roller 102 is rotationally driven by the driving mechanism 141, thus being rotated in an arrow B direction. The pressing roller 102 is driven by an unshown pressing mechanism using an eccentric cam and is movable toward and away from the fixing roller 101. The unshown pressing mechanism presses the pressing roller 102 at predetermined pressure against the fixing roller 101, so that the nip N is formed between the fixing roller 101 and the pressing roller 102.

A halogen heater 111 is provided non-rotatably inside the core metal 101*a* of the fixing roller 101. A thermistor 121 is provided in contact with the fixing roller 101 to detect a surface temperature of the fixing roller 101. A controller 140 effects ON/OFF control of the halogen heater 111 depending on a detected temperature by the thermistor 121, thus maintaining the surface temperature of the fixing roller 101 at a predetermined target temperature depending on the type of the recording material P.

A halogen heater 112 is provided non-rotatably inside the core metal 102*a* of the pressing roller 102. A thermistor 122 is provided in contact with the pressing roller 102 to detect a surface temperature of the pressing roller 102. The controller 140 effects ON/OFF control of the halogen heater 112 depending on a detected temperature by the thermistor 122, thus maintaining the surface temperature of the pressing roller 102 at the predetermined target temperature.

(Externally Heating Belt)

As shown in FIG. 2, the image forming apparatus 100 is required to provide high productivity (the print number per unit time) even with respect to the recording material such as thick paper having a large basis weight (weight per unit area). In order to enhance the productivity with respect to the recording material having the large basis weight, it is preferable that speed-up of heating by the fixing device 9 is adhered. However, the recording material having the large basis weight takes heat in a large amount, and therefore a heat quantity required for fixing is remarkably large compared with a recording material having a small basis weight.

Therefore, in the fixing device 9, an externally heating belt 105 as an endless belt is disposed so as to be contactable to and separable from the fixing roller 101. The externally heating belt 105 enhances heating efficiency of the fixing roller 101 by increasing a contact area in which heat is conducted from an upstream roller 103 and a downstream roller 104 to the fixing roller 101.

The fixing device 9 is stand-by for a subsequent image forming job in a state in which the externally heating belt 105 is spaced (separated) from the fixing roller 101. When the image forming job is sent to the image forming apparatus 100, preparatory operations are started in respective devices in the image forming apparatus 100, and a heating operation is started in the fixing device 9. In the heating operation, when temperatures of the fixing roller 101, the pressing roller 102, the upstream roller 103 and the downstream roller 104 reach target temperatures, respectively, the image forming job is started by bringing the externally heating belt 105 into press-contact with the fixing roller 101. Thereafter, when the image forming job is ended, the externally heating belt 105 is spaced from the fixing roller 101 and then is held until the time when subsequent image formation is started.

The externally heating belt 105 externally heats the fixing roller 101 by being contacted to the outer peripheral surface of the fixing roller 101 to form a heating portion (nip) Ne. The externally heating belt 105 includes a base layer of metal such as stainless steel or nickel or of a resin material such as polyimide. A surface of the base layer is coated with a heat-resistant slidable layer using a fluorine-containing resin material in order to prevent deposition of the toner. The externally heating belt 105 is triboelectrically driven with the rotation of the fixing roller 101, and thus is rotated in an arrow contact direction by the rotation of the fixing roller 101.

The upstream roller (supporting roller) 103 functioning as the supporting portion is formed of metal, such as aluminum, iron or stainless steel, having high thermal conductivity. A halogen heater 113 is penetrated through the center of the upstream roller 103 and is disposed non-rotatably. A thermistor 123 detects a temperature of the upstream roller 103 in contact with the externally heating belt 105 supported by the upstream roller 103. The controller 140 effects ON/OFF control of the halogen heater 113 depending on a detected temperature by the thermistor 123, thus keeping the temperature of the upstream roller 103 at a predetermined target temperature.

The downstream roller (supporting roller) 104 functioning as the supporting portion is formed of metal, such as aluminum, iron or stainless steel, having high thermal conductivity. A halogen heater 114 is penetrated through the center of the downstream roller 104 and is disposed non-rotatably. A thermistor 124 detects a temperature of the downstream roller 104 in contact with the externally heating belt 105 supported by the downstream roller 104. The controller 140 effects ON/OFF control of the halogen heater 114 depending on a detected temperature by the thermistor 124, thus keeping the temperature of the downstream roller 104 at a predetermined target temperature.

The target temperature for temperature adjustment of the upstream roller 103 and the downstream roller 104 is set at a value higher than the target temperature for temperature adjustment of the fixing roller 101. This is because when the surface of the upstream roller 103 and the downstream roller 104 is kept at a value higher than the surface temperature of the fixing roller 101, heat can be efficiently supplied to the fixing roller 101 lowered in surface temperature. During continuous image formation with respect to thick paper, compared with the target temperature of the fixing roller 101 set at 165° C., the target temperature of the upstream roller 103 and the downstream roller 104 is set at 230° C. Thus, the surface temperature of the upstream roller 103 and the downstream roller 104 is kept at a value higher than the surface temperature of the fixing roller 101 by 75° C.

A surface layer of the externally heating belt 105 is contaminated by deposition of a foreign matter, such as the toner or paper powder, transferred (offset) from the recording material. A cleaning roller 108 adsorbs the foreign matter, such as the toner or the paper powder, on a silicone rubber layer provided on a surface thereof. The cleaning roller 108 is urged at predetermined pressure by the externally heating belt 105 and is rotated by rotation of the externally heating belt 105, thus cleaning the surface of the externally heating belt 105.

(Roller Supporting Mechanism)

Figure 3:
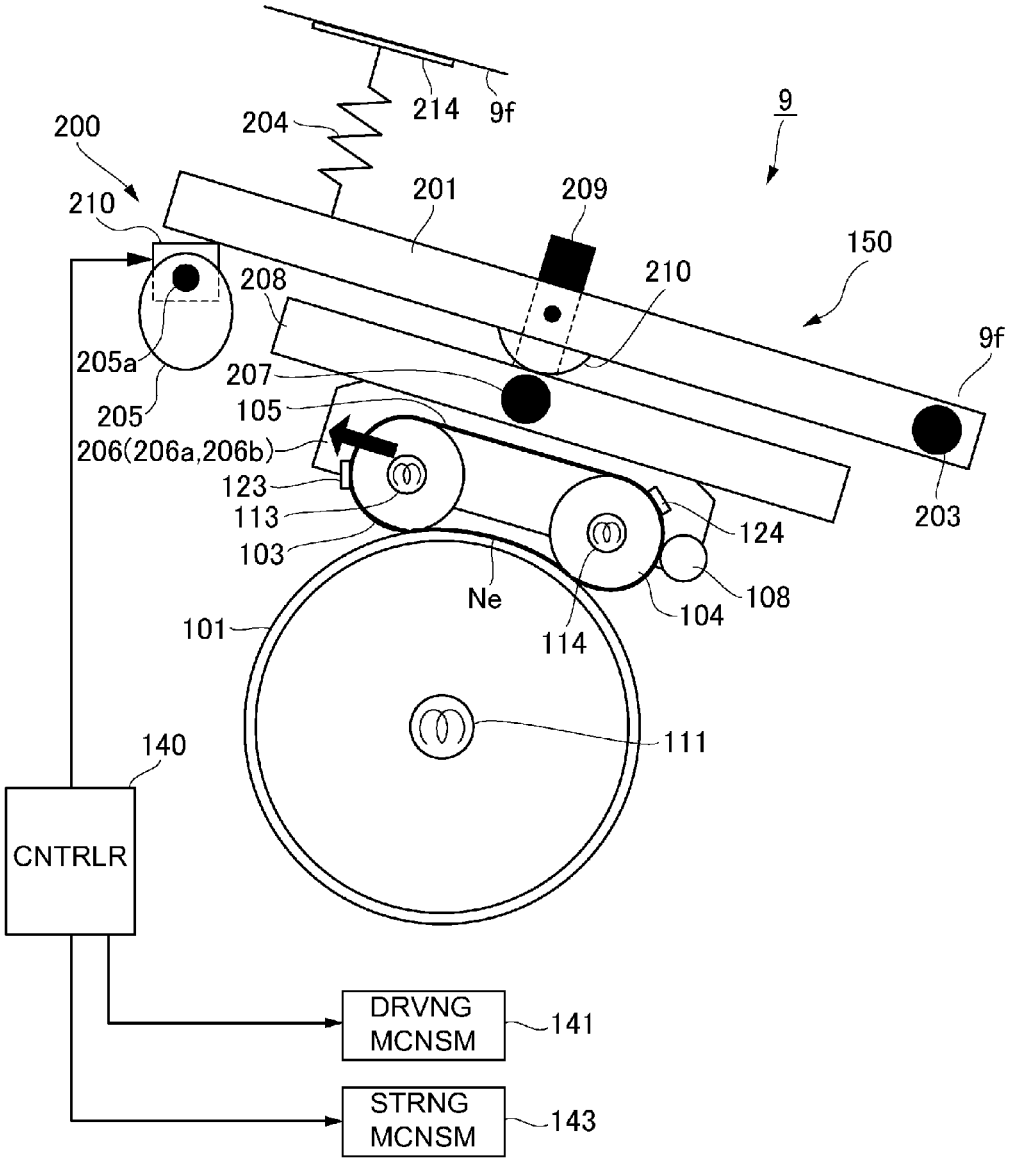
FIG. 3 is an illustration of a structure of a contact and separation mechanism for an externally heating belt.

FIG. 3 is an illustration of a contact and separation mechanism for the externally heating belt. Parts (a) and (b) of FIG. 4 are a perspective view of an outer appearance and a mechanism view, respectively, of the externally heating unit. FIG. 5 is an illustration of a crossing angle between the fixing roller and the externally heating belt.

As shown in FIG. 3, the externally heating belt 105 is extended and stretched by the upstream roller 103 and the downstream roller 104. The externally heating belt 105 is rotatably supported at an inner surface thereof by the upstream roller 103 and the downstream roller 104 so as to be rotated by rotation of the fixing roller 101.

The externally heating belt 105 is movable toward away from the fixing roller 101 by the contact and separation mechanism 200. The contact and separation mechanism 200 also functions as a press-contact mechanism for causing the upstream roller 103 and the downstream roller 104 to press-contact the externally heating belt 105 against the fixing roller 101. A pressing frame 201 functioning as a pressing mechanism is rotatable about a supporting shaft 203 relative to a casing frame **9*f* of the fixing device 9. Between a rotation end portion of the pressing frame 201 and the casing frame 9*f* of the fixing device 9, a pressing spring 204 is provided. The pressing spring 204 presses down the rotation end portion of the pressing frame 201 to urge a swinging frame 208 toward the fixing roller 101. The swinging frame 208 is rotatably supported relative to the pressing frame 201, by a pair of intermediate rollers 210 provided in front and rear sides of the pressing frame 201. In a state in which the upstream roller 103 and the downstream roller 104 are press-contacted to the externally heating belt 105 against the fixing roller 101, the pressing spring 204 presses the upstream roller 103 and the downstream roller 104** at total pressure of 392 N (about 40 kgf).

A pressure-releasing cam 205 contacts a lower surface of the rotation end portion of the pressing frame 201. The controller 140 controls a motor 210 to rotate the pressure-releasing cam 205 about a rotation shaft **205*a*, thus raising and lowering the rotation end portion of the pressing frame 201. When the pressure-releasing cam 205 is spaced from the pressing frame 201, the pressing spring 204 presses down the rotation end portion of the pressing frame 201, so that the externally heating belt 105 is press-contacted to the fixing roller 101. When the pressure-releasing cam 205 compresses the pressing spring 204 to press up the pressing frame 201, the externally heating belt 105 is spaced from the fixing roller 101**.

As shown in (a) of FIG. 4, front-side end portions of the upstream roller 103 and the downstream roller 104 are supported by a roller holding frame 206*a* functioning as a holding portion, and rear-side end portions of the upstream roller 103 and the downstream roller 104 are supported by a roller holding frame 206*b* functioning as the holding portion. As shown in (b) of FIG. 4, the front-side roller holding frame 206*a* is rotatably supported by supporting shafts 207*a* and 207*b* relative to the swinging frame 208. The rear-side roller holding frame 206*b* is rotatably supported by supporting shafts 207*c* and 207*d* relative to the swinging frame 208 functioning as the holding portion. The roller holding frame 206*a* rotatably shaft-supports the front-side end portions of the upstream roller 103 and the downstream roller 104 via unshown heat-resistant bush and bearing. The roller holding frame 206*b* rotatably shaft-supports the rear-side end portions of the upstream roller 103 and the downstream roller 104 via unshown heat-resistant bush and bearing.

The pressing spring 204 is disposed at each of longitudinal end portions of the pressing frame 201. The pair of pressing springs 204 causes the externally heating belt 105 to press-contact the outer peripheral surface of the fixing roller 101 at predetermined pressure via the upstream roller 103 and the downstream roller 104. As shown in FIG. 3, a rectilinear line connecting the supporting shafts 207 (207*a*, 207*b*, 207*c*, 207*d*) and the center of the fixing roller 101 constitutes a perpendicular bisector of a rectilinear line connecting the centers of the upstream roller 103 and the downstream roller 104 in a state in which the externally heating belt 105 is intimately contacted to the fixing roller 101.

As shown in FIG. 5, in the case where the upstream roller 103 and the downstream roller 104 are tilted to provide a crossing angle θ between generatrices of the externally heating belt 105 and the fixing roller 101, at the rear-side end portions, one of the upstream roller 103 and the downstream roller 104 starts pressure application to the fixing roller 101 ahead of the other. At the same time, at the front-side end portions, the other one of the upstream roller 103 and the downstream roller 104 starts pressure application to the fixing roller 101*a* ahead of one of the rollers (another roller). At this time, a pressure difference between the upstream roller 103 and the downstream roller 104 autonomously rotates the front-side roller holding frame 206*a* and the rear-side roller holding frame 206*b* to cancel an end portion pressure difference between the upstream roller 103 and the downstream roller 104. The front-side roller holding frame 206*a* and the rear-side roller holding frame 206*b* are rotated relative to each other to determine positions of the upstream roller 103 and the downstream roller 104 at tilt positions depending on a curved surface of the fixing roller 101. A relative tilt angle between the upstream roller 103 and the downstream roller 104 varies freely, and therefore attitudes of the upstream roller 103 and the downstream 104 are autonomously corrected to the tilt positions depending on the curved surface of the fixing roller 101, so that the externally heating belt 105 is closely contacted to the fixing roller 101. Both of the upstream roller 103 and the downstream roller 104 are uniformly pressed, so that not only in the front side but also in the rear side, sufficiently external heating is made from the upstream roller 103 and the downstream roller 104 to the fixing roller 101 via the externally heating belt 105.

(Steering Mechanism)

FIG. 6 is an illustration of a steering mechanism for the externally heating belt. FIG. 7 is an illustration of a driving portion of the steering mechanism. FIG. 8 is an enlarged view of the driving portion of the steering mechanism.

As shown in FIG. 6, the fixing roller 101 is rotatably supported by main assembly side plates 202 as an example of a supporting casing the heat an image surface of the recording material. The externally heating belt 105 is rotated while forming a contact surface between the externally heating belt 105 and the fixing roller 101. The upstream roller 103 and the downstream roller 104 stretch the externally heating belt 105. The swinging frame 208 rotatably supports the upstream roller 103 and the downstream roller 104. The halogen heaters 113 and 114 as a heating mechanism (heater) heat the upstream roller 103 and the downstream roller 104. The externally heating belt 105 is rotated by rotation of the fixing roller 101 to heat the outer peripheral surface of the fixing roller 101.

The pressing frame 201 is detachably mounted between the main assembly side plates 202, and rotatably supports the swinging frame 208 so that the crossing angle θ is formed between the generatrices of the fixing roller 101 and the externally heating belt 105 at the contact surface. A roller 128 functioning as a contact portion is provided on the swinging frame 208 and is used for detecting a widthwise position of the externally heating belt 105 in contact with the externally heating belt 105.

A worm wheel 118 functioning as a tilting portion (rotating portion) is capable of setting the crossing angle θ by rotating the swinging frame 208 relative to the pressing frame 201. The controller 140 controls a motor 125 to control lateral deviation (shift) movement of the externally heating belt 105.

The pressing frame 201 is detachably mounted between the main assembly side plates 202. The pressing frame 201 rotatably supports the swinging frame 208 so as to form the crossing angle θ between the generatrices of the fixing roller 101 and the externally heating belt 105 at the contact surface.

As shown in FIG. 5, the externally heating belt 105 is shifted and moved (laterally deviated) along the upstream roller 103 and the downstream roller 104 during a rotational operation. The cause of the lateral deviation movement is deviation in parallelism between the upstream roller 103 and the downstream roller 104, the crossing angle θ described above, and the like. Therefore, steering control in which the crossing angle θ between the externally heating belt 105 and the fixing roller 101 is externally changed forcedly to invert the direction of the lateral deviation movement of the externally heating belt 105 to cause a lateral deviation movement range of the externally heating belt 105 to fall within a predetermined zone is executed.

As shown in FIG. 6, the upstream roller 103 and the downstream roller 104 which stretch the externally heating belt 105 are tilted as a unit about a rotation shaft 209 to intentionally set the crossing angle θ between the externally heating belt 105 and the fixing roller 101, so that the lateral deviation direction of the externally heating belt 105 is controlled. The rotation shaft (swinging shaft) 209 is a rotation center (swinging center) for changing the crossing angle θ between the externally heating belt 105 and the fixing roller 101. Specifically, the rotation shaft 209 is provided in an opposite side from the fixing roller 101 with respect to the externally heating belt 105 and is located between the upstream roller 103 and the downstream roller 104, and constitutes an axis extending in substantially parallel to a direction of a normal to a flat surface of the externally heating belt 105 in a side remote from the fixing roller 101.

The rotation shaft 209 is provided along a direction of a normal to the contact surface where the externally heating belt 105 is contacted to the fixing roller 101. The crossing angle θ is set for the externally heating belt 105 with the rotation shaft 209 as the center. The supporting shaft 203 of the pressing frame 201 is fixed between the main assembly side plates 202 at ends thereof. The swinging frame 208 and the externally heating belt 105 are rotatable as a unit, relative to the pressing frame 201, about the rotation shaft 209. The supporting shaft 207*a* fixed on the swinging frame 208 is held with a clearance from the main assembly side plate 202, and is movable in arrow H and J directions, in a clearance range, with movement of an arm portion 118*a* of the worm wheel 118.

The sector worm wheel 118 rotatable about the rotation shaft 119 is engaged with a worm gear 120. When the motor 125 is rotated in a normal direction to rotate the worm wheel 118 in an arrow G, the arm portion 118*a* is moved in the arrow H direction to move the supporting shaft 207*a* in the arrow H direction. When the motor 125 is rotated in a reverse direction to rotate the worm wheel 118 in an arrow I direction, the arm portion 118*a* is moved in the arrow J direction to move the supporting shaft 207*a* in the arrow J direction (FIGS. 7 and 8).

When the swinging frame 208 is moved in the arrow H or J direction in the front side, the upstream roller 103 and the downstream roller 104 are rotated around the rotation shaft 209, so that the crossing angle θ is set between the fixing roller 101 and the upstream and downstream rollers 103 and 104. There is a relationship the crossing angle θ between the fixing roller 101 and the externally heating belt 105 and a lateral deviation (shift) speed of the externally heating belt 105. A lateral deviation force of the externally heating belt 105 is changed depending on an amount of movement of the arm portion 118*a*, so that a direction and speed of the lateral deviation (movement) of the externally heating belt 105 along the upstream and downstream rollers 103 and 104 are controlled.

In the case where the supporting shaft 207*a* is moved from a point where the shift force is zero to the H direction, the shift force for moving the externally heating belt 105 toward the rear side (arrow M direction) of the fixing roller 101 becomes large. In the case where the supporting shaft 207*a* is moved from the point where the shift force is zero to the J direction, the shift force for moving the externally heating belt 105 toward the front side (arrow L direction) of the fixing roller 101 becomes large. In this way, by moving the supporting shaft 207*a* in the arrow H and J directions, a direction in which the externally heating belt 105 is shifted can be controlled.

(Belt Lateral Deviation Amount Detecting Sensor)

FIG. 9 is an illustration of an arrangement of a belt lateral deviation amount detecting sensor functioning as a detecting portion. Parts (a) and (b) of FIG. 10 are illustrations each showing a relationship between a belt lateral deviation direction and a sensor flag rotational direction.

As shown in FIG. 9, the roller 128 functioning as the contact portion is provided on the swinging frame 208 and is constituted so as to be movable together with the externally heating belt 105 in a widthwise direction in contact with a widthwise end (edge) of the externally heating belt 105. The roller 128 is rotatably mounted on an arm 129. The arm 129 is rotatable about a rotation shaft 136 is urged in an arrow Q (direction with a force of about 2N (200 gf) by an urging portion 131 in which a torsion spring is incorporated. The arm 129 is linked with a sector sensor flag 132. The sensor flag 132 is interrelated with the roller 128, i.e., motion of the arm 129, and is rotated. The sensor flag 132 is detected by photo-interruptors 133 and 134.

As shown in (a) of FIG. 10, the sensor flag 132 is provided with two slits SL1 and SL2. Along the sensor flag 132, photo-interruptors 133 and 134 are provided. The photo-interruptors 133 and 134 detect four edges of the two slits SL1 and SL2 formed in the sensor flag 132 and invert outputs of the detection. Correspondingly to the four edges of the sensor flag 132, lateral deviation positions of the externally heating belt 105 are defined. In the case where the externally heating belt 105 is shifted in the arrow R direction, the arm 129 is rotated in an arrow S direction, so that the sensor flag 132 is rotated in an arrow T direction to turn off the photo-interruptor 133 and to turn on the photo-interruptor 134. As a result, the lateral deviation of the externally heating belt 105 toward the front direction (arrow L direction of FIG. 6) is discriminated.

As shown in (b) of FIG. 11, in the case where the externally heating belt 105 is shifted in the arrow Q direction, the arm 129 is rotated in an arrow U direction, so that the sensor flag 132 is rotated in an arrow V direction to turn on the photo-interruptor 133 and to turn off the photo-interruptor 134. As a result, the lateral deviation of the externally heating belt 105 toward the rear direction (arrow M direction of FIG. 6) is discriminated.

As shown in FIG. 6, by combining the steering with the belt lateral deviation amount detecting sensor, it becomes possible to effect the lateral deviation control of the externally heating belt 105.

A state (position) in which the upstream roller 103 and the downstream roller 104 are located so that axial directions thereof are parallel to the generatrix direction of the fixing roller 101 is referred to as a home position. In this way, the frame supporting shaft 207*a* is positioned by the sector worm wheel 118.

Then, by the rotation of the fixing roller 101, the externally heating belt 105 is rotated and then is laterally deviated (shifted) and moved in either one of the directions toward the front side and the rear side. At a stage in which the position of the laterally deviated (moved) externally heating belt 105 reaches a predetermined position, a mounting position of the frame supporting shaft 207*a* is shifted so that a lateral deviation (shifting) force is exerted in an opposite direction to the lateral deviation direction of the externally heating belt 105. In this embodiment, as an example, the photo-interruptors 133 and 134 are disposed so that the lateral deviation is detected when the externally heating belt 105 is moved from an end portion toward an opposite end portion (the other end portion) by 5 mm.

FIG. 11 is an illustration of an exchanging operation of the externally heating belt 105. As shown in FIG. 6, the lateral deviation movement of the externally heating belt 105 is controlled by changing the crossing angle θ between the externally heating belt 105 and the fixing roller 101. For this purpose, as shown in FIG. 9, the rotation shaft 136 of the roller 128 contacting the widthwise edge of the externally heating belt 105 is disposed, in the swinging frame 208, as a unit with the upstream roller 103 and the downstream roller 104 which stretch the externally heating belt 105. The roller 128 for detecting the lateral deviation position of the externally heating belt 105 in contact with the externally heating belt 105 is disposed in the swinging frame 208 for changing the crossing angle θ relative to the fixing roller 101.

However, in the case where the rotation shaft 136 of the roller 128 is disposed in the swinging frame 208, also in a state of an externally heating unit 150 alone, the roller 128 is placed in a state in which the roller 128 contacts the edge of the externally heating belt 105 by an urging force.

As shown in FIG. 11, the externally heating unit 150 is placed on a table with the pressing frame 201 downward and then is to be subjected to an exchanging (replacing) operation in that state, but there is a fear that a problem described below occurs. That is, in order to remove (demount) the externally heating belt 105 from the externally heating unit 150, when the two rollers 103 and 104 in a state in which the belt 105 is stretched between the two rollers 103 and 104 are raised in a state in which the roller 128 is caught by the edge of the externally heating belt 105, the roller 128 is pulled in the externally heating belt 105, thus constituting an obstacle to the exchanging operation.

Therefore, in this embodiment, a retracting mechanism for retracting the roller 128 for detecting the lateral deviation position of the externally heating belt 105 is provided, so that the catch of the roller 128 by the externally heating belt 105 during exchanging (replacement) of the externally heating belt 105 in the externally heating unit 150 alone is eliminated. In interrelation with the removing operation of the externally heating unit 150 from the fixing device 9, the roller 128 is retracted from the externally heating belt 105 to eliminate the contact between the roller 128 and the externally heating belt 105.

(Sensor Retracting Mechanism)

FIG. 12 is an illustration of an operation of a sensor retracting mechanism functioning as a retracting portion. FIG. 13 is an illustration of a structure of the sensor retracting mechanism in Embodiment 1. FIG. 14 is a schematic view of an operation of a retracting member.

As shown in FIG. 12, a retracting member 211 eliminates the contact of the roller 128 with the externally heating belt 105 in interrelation with demounting of a predetermined member for removing the externally heating unit 150 as a unit from the main assembly side plates 202. The arm 129 as an example of a first lever member is shift-supported by the swinging frame 208. An urging member 131 as an example of a first urging means applies a first torque to the arm 129, so that a rotation end of the arm 129 is contacted to the externally heating belt 105.

The retracting member 211 as an example of a second lever member is shaft-supported by the pressing frame 201 or the swinging frame 208. An urging member 213 as an example of a second urging means applies a second torque to the retracting member 211, so that the retract member 211 is engaged with the arm 129. The engaged retracting member 211 applies a torque, larger than the first torque, to the arm 129, so that the rotation end of the arm 129 is spaced from the externally heating belt 105.

The retracting member 211 eliminates the engagement between the retracting member 211 and the arm 129 by being rotated against the urging force of the urging member 219 in contact with the predetermined member.

The predetermined member is a member to be demounted from the main assembly side plates 202 in advance of a demounting operation of the pressing frame 201 from the main assembly side plates 202. The predetermined member is a member for urging the pressing frame 201 toward the fixing roller 101 in order to bring the externally heating belt 105 into contact with the fixing roller 101.

As shown in FIG. 12, before the externally heating unit 150 is demounted from the fixing device 9, a pressing stay 214 including an externally heating pressing spring 204 is demounted from the main assembly side plates 202 (FIG. 6) of the fixing device 9. With this operation, pressing-in of the retracting member 211 by a projected portion 215 is eliminated, and then the retracting member 211 is contacted to the arm 129 to forcedly rotate the arm 211, so that the roller 128 is moved to a spaced position from the externally heating belt 105.

As shown in FIG. 13, the roller 128 is rotatably held by the arm 129 and is contacted to the externally heating belt 105. The urging member 131 applies the torque to the arm 129 so that the arm 129 is always rotated in a direction (arrow Q direction) toward the externally heating belt 105.

The retracting member 211 is shaft-supported by the rotation shaft 212 on the pressing frame 201, and is rotatably disposed. The retracting member 211 applies, when the retracting member 211 is contacted to the arm 129, the torque larger than the torque of the urging member 131 in an opposite direction, thus forcedly rotating the arm 129 in an arrow W direction. When the arm 129 is rotated in the arrow W direction, the roller 128 is rotated in an opposite direction (arrow R direction) to a direction (arrow Q direction) toward the edge of the externally heating belt 105, so that the roller 128 is spaced from the edge of the externally heating belt 105.

The urging member 213 applies the torque so that the retracting member 211 is always rotated in a direction (arrow X direction) toward the arm 129. The torque applied from the retracting member 211 to the arm 129 by the urging member 213 is set at a value larger than the torque applied from the urging member 131 to the arm 129. In this embodiment, the urging member 213 is contacted to the arm 129 with a force corresponding to a total pressure of about 5 N (500 gf).

As shown in FIG. 14, in a state in which the retracting member 211 is rotatable by being urged by the urging member 213, an engaging portion 129*p* of the arm 129 is urged by an engaging portion 211*p* of the retracting member 211, so that the arm 129 is rotated. As a result, the roller 128 is rotated to a position remotest from the externally heating belt 105.

As shown in FIG. 11, in the state of the externally heating unit 150 alone, the roller 128 is always spaced from the edge of the externally heating belt 105. With respect to the externally heating unit 150, in a state in which the externally heating unit 150 is mounted on the table with the pressing roller 201 downward, the externally heating belt 105 is replaced. At this time, the roller 128 is spaced from the externally heating belt 105, and therefore when the upstream roller 103 and the downstream roller 104 are raised, the externally heating belt 105 is not caught by the roller 128.

As shown in FIG. 12, after the externally heating unit 150 is fixed between the main assembly side plates 202 (FIG. 6) of the fixing device 9, the pressing stay 214 is mounted between the main assembly side plates 202 (FIG. 6) as in the original state. At this time, the projected portion 215 disposed on the pressing stay 214 is contacted to the retracting member 211 to rotate the retracting member 211 in an opposite direction (arrow Y direction) to the urging direction by the urging member 213, so that the retracting member 211 is stopped in a position spaced from the arm 129. The arm 129 is spaced from the retracting member 211, so that the urging force by the retracting member 211 is eliminated, and therefore the arm 129 is driven by the torque of the urging member 131 to be rotated in the direction (arrow W direction) toward the externally heating belt 105, with the result that the roller 128 is contacted to the edge of the externally heating belt 105.

Thereafter, image formation is started and in a state in which the externally heating belt 105 is rotated to cause the lateral deviation movement, the lateral deviation position of the externally heating belt 105 is detected in real time by the medium of the roller 128, and then the lateral deviation movement of the externally heating belt 105 is controlled as described above. On the basis of a result of precise measurement by using the roller 128, by changing the crossing angle θ between the fixing roller 101 and the externally heating belt 105, the lateral deviation control of the externally heating belt 105 is accurately controlled.

In this embodiment, in the state of the externally heating unit 150 alone, the roller 128 is always spaced from the edge of the externally heating belt 105. In the state of the externally heating unit 150 alone, a retracted state of the roller 128 from the edge of the externally heating belt 105 is maintained. For this reason, when the externally heating belt 105 is demounted from the externally heating unit 150 and then is mounted again into the externally heating unit 150, the externally heating belt 105 is prevented from being caught by the roller 128, so that the exchanging operation becomes efficient. Thus, it is possible to provide the externally heating unit 150 enhanced in operation efficiency when the externally heating belt 105 of the externally heating unit 150 is replaced, and also to provide the fixing device 9 using the externally heating unit 150.

In this embodiment, the retracting member 211 for forcedly retracting the roller 128 from the externally heating belt 105 with the demounting operation of the externally heating unit 150 is disposed. Then, with a re-mounting operation of the externally heating unit 150 into the fixing device 9, the retracting member 211 is forcedly spaced from the arm 129, so that the retracted state of the roller 128 is automatically eliminated. In this embodiment, the pressing stay 214 for pressing the externally heating unit 150 has the function of eliminating the retracting state of the arm 129, and therefore, during the image formation, the roller 128 is always contacted to the externally heating belt 105.

In this embodiment, in a process in which the externally heating unit 150 is demounted from the fixing device 9, the roller 128 is automatically retracted from the edge of the externally heating belt 105, and therefore there is no need to perform an independent manual operation for retracting the roller 128 from the edge of the externally heating belt 105. Further, in a process in which the externally heating unit 150 is mounted into the fixing device 9, the roller 128 is automatically contacted to the edge of the externally heating belt 105, and therefore there is no need to perform an independent manual operation for bringing the roller 128 into contact with the edge of the externally heating belt 105.

Embodiment 2

FIG. 15 is an illustration of an operation of a sensor retracting mechanism. FIG. 16 is an illustration of a structure of the sensor retracting mechanism. FIG. 17 is an illustration of an operation of a retracting member.

As shown in FIG. 12, in Embodiment 1, the pressing stay 214 is mounted between the main assembly side plates 202 (FIG. 6), so that the retracting member 211 is spaced from the arm 129 which holds the roller 128. On the other hand, the predetermined member in this embodiment is a main assembly side plate 202. In this embodiment, as shown in FIG. 15, the externally heating unit 150 is mounted between the main assembly side plates 202 (FIG. 17) of the fixing device 9, so that the retracting member 211 is immediately spaced from the arm 129 which holds the roller 128. Incidentally, in this embodiment, constituent elements except for the retracting member and the main assembly side plate are the same as those in Embodiment 1, and therefore in FIGS. 15 to 17, the constituent elements common to Embodiments 1 and 2 are represented by the same reference numerals or symbols as those in FIGS. 9 to 14, and will be omitted from redundant description.

As shown in FIG. 15, in order to retract the roller 128 from the externally heating belt 105, the main assembly side plate 202 is provided with a projected portion 220. When the externally heating unit 150 is demounted from the main assembly side plate 202 and is raised, the projected portion 220 provided on the main assembly side plate 202 is spaced from a retracting member 217. The retracting member 217 is rotated in a direction (arrow a direction) in which the retracting member 217 is urged by an urging member 219, so that an engaging portion 217*p* of the retracting member 217 is engaged with the engaging portion 129*p* of the arm 129. The arm 129 is rotated, by being urged by the retracting member 217, in a direction in which the arm 129 resists urging by the urging member 131, so that the roller 128 is spaced from the externally heating belt 105.

As shown in FIG. 16, the roller 128 is rotatably held by a rotation end of the arm 129 shaft-supported on the swinging frame 208, and is contacted to the edge of the externally heating belt 105. The arm 129 is always urged in the direction (arrow Q direction) toward the externally heating belt 105 by the urging member 131.

A pressing arm 216 is fixed at a side portion of the pressing frame 201. The retracting member 217 is rotatable about a rotation shaft 218 fixed on the pressing arm 216. The urging member 219 incorporates a torsion spring therein and urges the retracting member 217 so that the retracting member 217 is always moved in a direction (arrow Z direction) toward the arm 129.

As shown in FIG. 17, a torque of the urging member 219 is selected so that when the retracting member 217 is engaged with the arm 129, a torque larger than a torque applied from the urging member 131 to the arm 129 acts on the arm in an opposite direction. For this reason, in the state in which the externally heating unit 150 is demounted alone, the arm 129 is rotated to a position where the roller 128 is remotest from the externally heating belt 105. The roller 128 is spaced from the edge of the externally heating belt 105, and therefore when the upstream roller 103 and the downstream roller 104 are demounted while stretching the externally heating belt 105 in the operation for replacing the externally heating belt 105, the externally heating belt 105 is prevented from being caught by the roller 128.

As shown in FIG. 15, when the externally heating unit 150 is mounted between the main assembly side plates 202 of the fixing device 9, the retracting member 217 is immediately spaced from the arm 129 which holds the roller 128. In a process in which the externally heating unit 150 is mounted between the main assembly side plates 202, the projected portion 220 disposed on the main assembly side plate 202 contacts the retracting member 211, so that the retracting member 217 is rotated in a direction (arrow a direction) in which the retract member 217 resists the urging force of the urging member 219. As a result, the engagement of the arm 129 with the retracting member 217 is eliminated (released).

Further, in a state in which the externally heating unit 150 is mounted between the main assembly side plates 202, the retracting member 217 is held in a rotation position spaced from the arm 129. As a result, in a state in which the externally heating unit 150 is mounted in the fixing device 9, it becomes possible to always detect the lateral deviation position of the externally heating belt 105 by the medium of the roller 128. The arm 128 receives only the torque by the urging member 131, so that the roller 128 is rotated in a direction in which the roller 128 approaches the externally heating belt 105, and thus is contacted to the edge of the externally heating belt 105.

When the externally heating unit 150 is demounted from the fixing device 9, the roller 128 is retracted from the externally heating belt 105. Then, in interrelation with the mounting operation of the externally heating unit 150 into the fixing device 9, the roller 128 is contacted to the externally heating belt 105. In Embodiment 2, it is possible to move the roller 128 toward and away from the externally heating belt 105 without demounting and mounting parts other than the externally heating unit 150. For this reason, in this embodiment, compared with Embodiment 1, the contact of the roller 128 with the externally heating belt 105 can be ensured with high reliability. During use of the externally heating unit 150, it becomes possible to reliably bring the roller 128 into contact with the edge of the externally heating belt 105. However, in this embodiment, compared with Embodiment 1, the constitution is complicated, and a periphery of the arm 129 is required to ensure a wide space.

Even in the case where the image formation is executed in a state in which the pressing stay 214 is not mounted, the lateral deviation control can be effected by bringing the roller 128 into contact with the externally heating belt 105 to detect the lateral deviation position of the externally heating belt 105. For that reason, in this embodiment, there is no need to provide a mechanism for preventing forgetfulness to mount the pressing stay 214.

In the above, Embodiments 1 and 2 to which the present invention is applicable are described in detail, but within the concept of the present invention, a part or all of constituents can be replaced with their alternative constituent elements.

Accordingly, the heating method for the externally heating belt and the fixing roller is not limited to the halogen heater. For example, an electromagnetic induction heating mechanism may also be used.

The image heating apparatus includes, in addition to the fixing device, a surface heating apparatus for adjusting image gloss and a surface property of a partly or completely fixed image, and includes a curl removing apparatus of the recording material on which the fixed image is formed. The image heating apparatus may also be, other than in the constitution in which the image heating apparatus is assembled with the image forming apparatus, carried out as a single apparatus or component which is disposed and operated alone. The image forming apparatus can be carried irrespective of types of monochromatic/full-color, sheet-feeding/recording material conveyance intermediary transfer, toner image formation, and toner image transfer. The present invention can be carried out in the image forming apparatuses in various fields, such as printers, various printing machines, copying machines, facsimile machines and multi-function machines, by adding a device, equipment and a casing structure which are necessary for the image heating apparatus.

Further, in Embodiments 1 and 2, as an example to which the present invention is applied, the image heating apparatus (fixing device) is described, but, e.g., the present invention is similarly applicable to also the following constitution.

For example, the present invention is applicable to a constitution in which an endless intermediary transfer belt as the intermediary transfer member is used. In this constitution, the intermediary transfer belt is configured to be rotatable by two supporting rollers so as to be rotated by rotation of the photosensitive member, and such intermediary transfer belt and two supporting rollers are disposed to cross as a unit with the generatrix direction (axial direction) of the photosensitive member similarly as in the above-described embodiments. In this way, the present invention can be similarly applied as a lateral deviation mechanism for the intermediary transfer belt. In addition, the present invention is also applicable to an endless belt, to be provided in the image forming apparatus, configured to be rotatably supported at an inner surface thereof by two supporting rollers so as to be rotated by rotation of a rotatable driving member. In this case, the endless belt and the two supporting rollers are constituted to cross as a unit with the generatrix direction (axial direction) of the rotatable driving member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 263767/2012 filed Nov. 30, 2012, which is hereby incorporated by reference.

What is claimed is:

1. An image heating apparatus comprising:

a rotatable heating member configured to heat an image on a sheet;

a belt unit including an endless belt configured to heat said rotatable heating member in contact with a part of an outer surface of said rotatable heating member spaced from the sheet, and a supporting portion configured to rotatably support an inner surface of said endless belt;

a moving portion configured to move said belt unit between a position where said endless belt and said rotatable heating member contact each other and a position where said endless belt and said rotatable heating member are away from each other;

a contact portion configured to contact a widthwise edge of said endless belt;

an urging portion configured to urge said contact portion toward the widthwise edge of said endless belt;

a detecting portion configured to detect that said endless belt is out of a predetermined zone depending on a position of said contact portion in a widthwise direction of said endless belt;

a tilting portion configured to tilt said belt unit in a direction of causing said endless belt to return into the predetermined zone on the basis of an output of said detecting portion; and a retracting portion configured to retract said contact portion from said endless belt against an urging force of said urging portion.

2. An image heating apparatus according to claim 1, further comprising a pressing mechanism configured to press said belt unit toward said rotatable heating member, wherein said retracting portion retracts said contact portion from said endless belt with a demounting operation of said pressing mechanism from said image heating apparatus.

3. An image heating apparatus according to claim 2, wherein said retracting portion permits contact of said contact portion with the widthwise edge of said endless belt with a mounting operation of said pressing mechanism into said image heating apparatus.

4. An image heating apparatus according to claim 1, wherein said retracting portion retracts said contact portion from said endless belt with a demounting operation of said belt unit from said image heating apparatus.

5. An image heating apparatus according to claim 4, wherein said retracting portion permits contact of said contact portion with the widthwise edge of said endless belt with a mounting operation of said belt unit into said image heating apparatus.

6. An image heating apparatus according to claim 1, wherein said supporting portion is a roller in which a heater is incorporated.

7. An image heating apparatus according to claim 1, further comprising a driving mechanism configured to rotationally drive said rotatable heating member, wherein said endless belt is constituted so as to be rotated by rotation of said rotatable heating member.

8. An image heating apparatus according to claim 1, wherein said rotatable heating member is a roller.

9. An image heating apparatus according to claim 1, further comprising a nip forming member configured to form a nip for nipping and conveying the sheet between said nip forming member and said rotatable heating member.

10. An image heating apparatus comprising:

a rotatable heating member configured to heat a toner image on a sheet;

a belt unit including an endless belt configured to heat said rotatable heating member in contact with a part of an outer surface of said rotatable heating member spaced from the sheet, and a supporting roller configured to rotatably support an inner surface of said endless belt;

a moving portion configured to move said belt unit between a position where said endless belt and said rotatable heating member contact each other and a position where said endless belt and said rotatable heating member are away from each other;

a contact portion configured to contact a widthwise edge of said endless belt;

an urging portion configured to urge said contact portion toward the widthwise edge of said endless belt;

a detecting portion configured to detect a widthwise position of said endless belt depending on a position of said contact portion in a widthwise direction of said endless belt;

a tilting portion configured to tilt, on the basis of an output of said detecting portion, said belt unit so that an axis of said supporting roller placed in a state in which said supporting roller presses said endless belt against said rotatable heating member crosses a generatrix of said rotatable heating member; and a retracting portion configured to retract said contact portion from said endless belt against an urging force of said urging portion.

11. An image heating apparatus comprising:

a rotatable heating member configured to heat a toner image on a sheet;

an endless belt configured to heat said rotatable heating member in contact with a part of an outer surface of said rotatable heating member spaced from the sheet;

two supporting rollers configured to rotatably support an inner surface of said endless belt;

a holding portion configured to hold said endless belt and said two supporting rollers;

a moving portion configured to move said holding portion between a position where said endless belt and said rotatable heating member contact each other and a position where said endless belt and said rotatable heating member are away from each other;

a contact portion configured to contact a widthwise edge of said endless belt;

an urging portion configured to urge said contact portion toward the widthwise edge of said endless belt;

a detecting portion configured to detect a widthwise position of said endless belt depending on a position of said contact portion in a widthwise direction of said endless belt; and a swinging portion configured to swing, on the basis of an output of said detecting portion, said holding portion so that said two supporting rollers placed in a state in which said two supporting rollers press said endless belt against said rotatable heating member cross as a unit with said rotatable heating member.

12. An image heating apparatus according to claim 11, further comprising a swinging shaft (i) disposed at an opposite side from said rotatable heating member with respect to said endless belt and (ii) extending in a direction substantially parallel to a direction of normal to a flat surface of an area, of said endless belt, which is positioned between said two supporting rollers and a side remote from said rotatable heating member, wherein said swinging portion swings said holding portion about said swinging shaft on the basis of an output of said detecting portion.

13. An image forming apparatus comprising:

a belt unit including an endless belt and a supporting portion configured to rotatably support an inner surface of said endless belt;

a rotatable driving member configured to rotate said endless belt by rotation thereof and to receive a sheet at a portion spaced from a contact portion in contact with an outer surface of said endless belt;

a moving portion configured to move said belt unit between a position where said endless belt and said rotatable driving member contact each other and a position where said endless belt and said rotatable driving member are away from each other;

a contact portion configured to contact a widthwise edge of said endless belt;

an urging portion configured to urge said contact portion toward the widthwise edge of said endless belt;

a detecting portion configured to detect that said endless belt is out of a predetermined zone, depending on a position of said contact portion in a widthwise direction of said endless belt;

a tilting portion configured to tilt said belt unit in a direction of causing said endless belt to return into the predetermined zone on the basis of an output of said detecting portion; and a retracting portion configured to retract said contact portion from said endless belt against an urging force of said urging portion.

14. An image forming apparatus comprising:

a belt unit including an endless belt and a supporting roller configured to rotatably support an inner surface of said endless belt;

a rotatable driving member configured to rotate said endless belt by rotation thereof and to receive a sheet at a portion spaced from a contact portion in contact with an outer surface of said endless belt;

a moving portion configured to move said belt unit between a position where said endless belt and said rotatable driving member contact each other and a position where said endless belt and said rotatable driving member are away from each other;

a contact portion configured to contact a widthwise edge of said endless belt;

an urging portion configured to urge said contact portion toward the widthwise edge of said endless belt;

a detecting portion configured to detect a widthwise position of said endless belt depending on a position of said contact portion in a widthwise direction of said endless belt;

a tilting portion configured to tilt, on the basis of an output of said detecting portion, said belt unit so that an axis of said supporting roller placed in a state in which said supporting roller presses said endless belt against said rotatable heating member crosses a generatrix of said rotatable heating member; and a retracting portion configured to retract said contact portion from said endless belt against an urging force of said urging portion.

15. An image forming apparatus comprising:

an endless belt:

two supporting rollers configured to rotatably support an inner surface of said endless belt;

a rotatable heating member configured to rotate said endless belt by rotation thereof and to receive a sheet at a portion spaced from a contact portion in contact with an outer surface of said endless belt;

a holding portion configured to hold said endless belt and said two supporting rollers;

a moving portion configured to move said holding portion between a position where said endless belt and said rotatable heating member contact each other and a position where said endless belt and said rotatable heating member are away from each other;

a contact portion configured to contact a widthwise edge of said endless belt;

an urging portion configured to urge said contact portion toward the widthwise edge of said endless belt;

a detecting portion configured to detect a widthwise position of said endless belt depending on a position of said contact portion in a widthwise direction of said endless belt; and a swinging portion configured to swing, on the basis of an output of said detecting portion, said holding portion so that said two supporting rollers placed in a state in which said two supporting rollers press said endless belt against said rotatable heating member cross as a unit with said rotatable heating member.

16. An image forming apparatus according to claim 15, further comprising a swinging shaft (i) disposed at an opposite side from said rotatable heating member with respect to said endless belt and (ii) extending in a direction substantially parallel to a direction of normal to a flat surface of an area, of said endless belt, which is positioned between said two supporting rollers and a side remote from said rotatable heating member, wherein said swinging portion swings said holding portion about said swinging shaft on the basis of an output of said detecting portion.

* * * * *